United States Patent [19]

Puzio

[11] Patent Number: 4,773,188

[45] Date of Patent: Sep. 27, 1988

[54] DEVICE FOR AUTOMATIC ADJUSTMENT OF GRINDING WHEEL POSITIONS

[76] Inventor: Eugene T. Puzio, 199 Park Ave., Trenton, N.J. 08690

[21] Appl. No.: 2,359

[22] Filed: Jan. 12, 1987

[51] Int. Cl.[4] ..... B24B 49/00

[52] U.S. Cl. ..... 51/165.87; 51/74 R; 125/11 CD

[58] Field of Search ..... 51/165.87, 165.88, 74, 51/103 WH, 134.5 R; 125/11 CD

[56] References Cited

U.S. PATENT DOCUMENTS

| | | | |
|---|---|---|---|
| 1,666,237 | 4/1928 | Fuller | 51/165.87 |
| 1,753,448 | 4/1930 | Smith | 125/11 CD |
| 2,545,730 | 3/1951 | Fouquet | 51/165.87 |
| 3,324,600 | 6/1967 | Wilson | 51/74 |
| 3,668,812 | 6/1972 | Idel | 51/165.87 |

FOREIGN PATENT DOCUMENTS

| | | | |
|---|---|---|---|
| 885666 | 8/1953 | Fed. Rep. of Germany | 51/165.87 |

*Primary Examiner*—Frederick R. Schmidt
*Assistant Examiner*—Maurina Rachuba
*Attorney, Agent, or Firm*—Sperry, Zoda & Kane

[57] ABSTRACT

A support for a grinding wheel or other rotary element use for conditioning workpieces, has the wheel arbor supported upon vertically shiftable support members, so that the distance between the lowermost, work engaging area of the wheel can be adjusted in respect to an underlying platen. In one form, slide blocks carry rotary idlers in tangential contact with diametrically opposite areas of the wheel, to sense wear of the wheel's periphery. As the wheel wears, the slide blocks gravitate to lower positions, to cause the wheel to be vertically adjusted downwardly to an extent that will maintain the distance between the bottom of the grinding wheel and the platen at a constant value. In a second form, an idler actuates an assemblage of links and levers that include the support members, to effect the downward vertical adjustment of the wheel.

7 Claims, 6 Drawing Sheets

DEVICE FOR AUTOMATIC ADJUSTMENT OF GRINDING WHEEL POSITIONS

BACKGROUND OF THE INVENTION

1. Field of the Invention

The present invention relates generally to the field of grinding or related operations utilized in the surface conditioning of workpieces. In a more particular sense, the invention relates to devices for automatically positioning grinding wheels relative to workpieces passed in successively following order into engagement with the grinding wheel. Even more particularly, the present invention automatically positions the grinding wheel in respect to an underlying platen, in an arrangement wherein there is an automatic take-up for wear of the periphery of the grinding wheel, to maintain the pass-through space between the grinding wheel and platen at a predetermined, constant value.

2. Description of the Prior Art

Heretofore, so far as is known it has not been proposed to provide a device that will automatically take up for wear of a grinding wheel periphery, in such a way as to cause the wheel arbor to automatically gravitate to the exact extent necessary for maintaining the work-engaging periphery of the wheel at a constant, predetermined distance from a platen or bed along which workpieces are being fed in successively following order.

A problem arises in, for example, grinding wheel operations needed for grinding down the surface of a workpiece an exact, predetermined amount. In such cases, it is common practice to feed the workpiece between the periphery of the grinding wheel and an underlying bed or platen. As successively following workpieces are ground down, there is an accompanying wearing down of the periphery of the wheel. As a result, the distance between the periphery of the wheel and the flat bed or platen along which the workpieces are being fed tends to increase. This requires constant readjustment of the wheel arbor toward the bed, to take up for the reduction in the wheel diameter resulting from the constant wearing of the periphery thereof.

Automatic repositioning of the wheel, to take up for wear, is of course highly desirable and the present invention has as its broad purpose the provision of means for automatic, continuous, relocation of the wheel arbor, so that without the attention of a worker, there is at all times, a constant, unvarying pass-through space between the wheel periphery and the work-supporting platen.

SUMMARY OF THE INVENTION

Summarized briefly, the invention includes a bed or platen, having fixed support blocks located at opposite sides of a grinding wheel spaced above the platen a distance sufficient to permit workpieces to pass under the grinding wheel so as to be ground down to a predetermined thickness. The support blocks have oppositely inclined surfaces, on which are slidably mounted mating slide blocks, carrying rollers that are in contact with the grinding wheel at diametrically opposite locations thereon. The rollers are journalled in grinding wheel bearing members or plates, on which the grinding wheel is rotatably mounted. As the grinding wheel wears down, the resulting reduction in diameter frees the rollers for movement toward each other to an extent corresponding to the reduction of the wheel diameter.

As a result, the slide blocks are permitted to slide downwardly, carrying the rollers with them. This causes the grinding wheel support or bearing plates to move downwardly, lowering the axis of rotation of the grinding wheel to the extent necessary to compensate for the wear of the wheel diameter. In this way, there is continual, automatic adjustment of the pass-through space for the workpieces, defined between the grinding wheel and the platen on which the workpieces are supported.

In another form of the invention, the wheel support members or plates are links incorporated in an assemblage of links and levers carrying a sensing roller. As the wheel wears, the roller actuates the articulated linkage in a manner to shift the wheel support links downwardly to take up for the wear of the wheel diameter. Thus, the basic concept of translating bodily movement of an idler roller or rollers responsive to wear of a wheel contacted thereby, into a downward movement of the wheel toward a platen to maintain a pass-through space at a constant value, is retained in both forms of the invention.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENT

Figure 1:
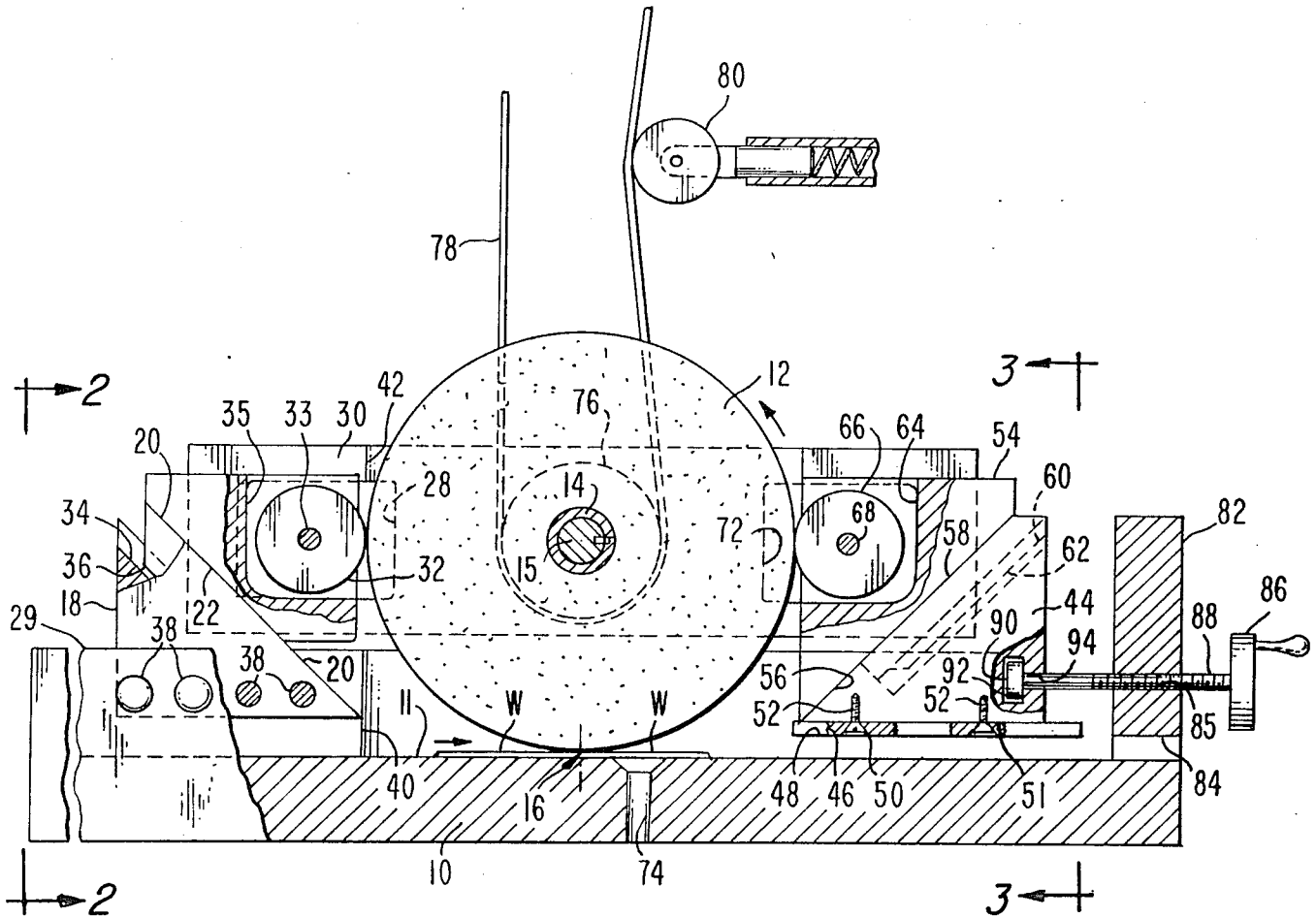
FIG. 1 is a view partly in side elevation and partly in longitudinal section, through a grinding wheel support device constructed according to the present invention, portions being broken away.
Figure 2:
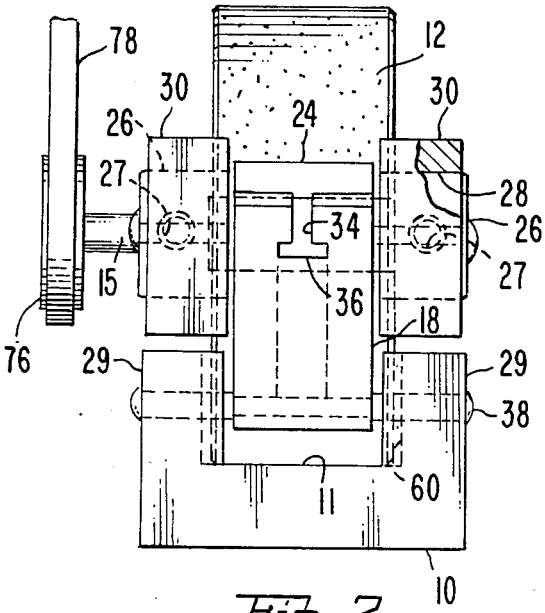
FIG. 2 is a cross-sectional view substantially on line 2—2 of FIG. 1, a portion being broken away.
Figure 3:
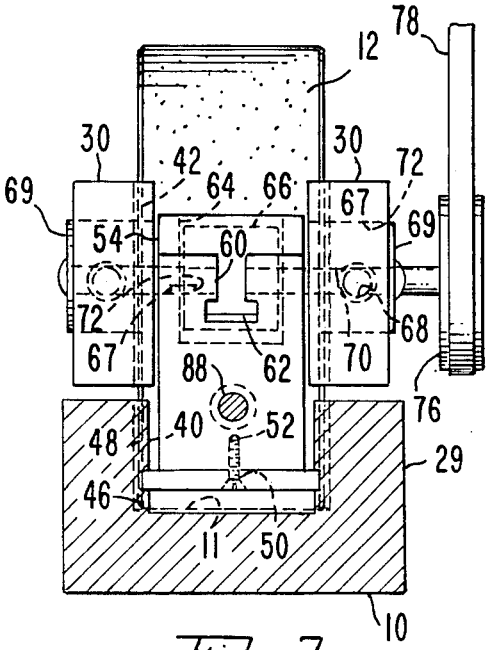
FIG. 3 is a transverse sectional view, substantially on line 3—3 of FIG. 1.

An elongated base or platen 10 is formed, as shown in FIGS. 2 and 3, as an upwardly opening U-shaped channel having a flat bed surface 11 along which workpieces W are fed in any suitable manner, in the present instance in the direction indicated by the arrow in FIG. 1, into contact with the periphery of a grinding wheel 12 rotatable with an arbor 14 keyed or otherwise made rotatable with a shaft 15.

A pass-through space 16 between the workpiece-supporting platen surface 11 and the grinding wheel is of a predetermined dimension selected to assure that the upper surface of each workpiece will be acted upon by the grinding wheel to the extent desired for the particular work being performed.

At this point, it may be noted that although the term "grinding wheel" is used throughout this description, the wheel 12 might, alternatively, be a buffing wheel, or other wheel having a surface designed to act upon the surface of each workpiece. Accordingly, although a grinding wheel is illustrated by way of example, the term "workpiece conditioning wheel" will be understood as referring, broadly, to any wheel having a surface that will condition or otherwise act upon the surface of a workpiece passed through the space 16.

Further, the term "platen" as used herein is intended to refer to any workpiece support element, whether it be flat, curved, stationary, or movable, so long as it presents a workpiece-support surface cooperating with the work-conditioning wheel to define a pass-through space therebetween.

Referring to FIG. 1, a support block 18 is disposed within the U-shaped base 10, and has an inclined surface 20 facing toward the adjacent portion of the periphery of the wheel 12. The inclined surface 20 is in slidable contact with a complementary inclined surface 22 formed upon the underside of an idler support block 24, thus mounting the block 24 slidably upon the block 18 for upward and downward movement in an inclined path. Referring to FIGS. 1 and 2, rectangular support lugs 26 are slidably urged by compression coil springs 27 mounted in recesses opening into support lug guide slots 28 of elongated work conditioning wheel support members 30 disposed (FIG. 2) at opposite sides of the superposed blocks 18, 24, above the side walls 29 of base 10.

Block 24, instead of being in slidable engagement with block 18, could be rollably mounted on the inclined surface 20, as for example by providing wheels or rollers either on one or the other of the inclined surfaces 20 or 22.

Figure 4:
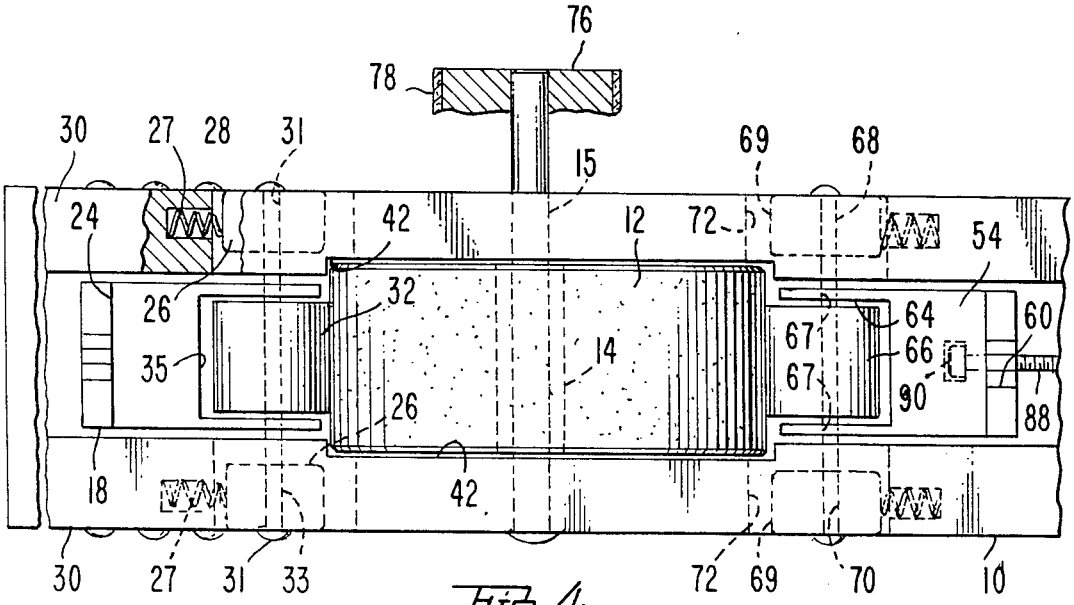
FIG. 4 is a top plan view of the form of the invention shown in FIG. 1, in which portions have been broken away.

Formed in the block 24 is an upwardly opening recess 35 (FIG. 4) receiving an idler roller 32, freely rotatable upon a pin 33 extending through bearing openings 31 formed in the support lugs 26.

Depending from the inclined undersurface 22 of block 24 is a correspondingly inclined guide rib 36 of inverted T-shaped cross-section, slidably confined within a mating, upwardly opening guide slot 34 (FIGS. 1 and 2) formed in the upper surface 20 of stationary support block 18, and inclined in parallelism with the surfaces 22, 24 and guide ribs 36.

The stationary support block 18 is fixedly mounted within the upwardly opening channel defined between side walls 29, by mounting pins 38 carried by the side walls and extending across the space therebetween (FIG. 2).

Accommodating the width of work conditioning wheel 12 are confronting, elongated, shallow clearance recesses 40 formed in side walls 29 (FIG. 1) and similar recesses 42 formed in the inner side surfaces of support members 30.

An idler roller means is in contact with wheel 12, at a location diametrically opposite the point at which roller 32 contacts the work conditioning wheel. This means includes a second stationary support block 44, which is fixedly secured to an elongated slide plate 46 (FIGS. 1 and 3) slidably engaged above the bed surface 11 in elongated guide slots 48 formed in the inner side surfaces of side walls 29 of base 10. Screws 50 extending through countersunk openings 51 of plate 46, are threadedly engaged in downwardly opening recesses 52 of block 44 to fixedly secure the plate 46 to the block.

Formed identically but oppositely to the slide block 24 is a slide block 54, the underside of which is inclined as at 56, and is in slidable contact with a correspondingly inclined upper surface 58 of support block 44. A T-slot 60 formed in surface 58 receives the mating tongue 62 of T-shaped cross-section formed on the underside of surface 56 of slide block 54, to guide the slide block 54 in its slidable movement upon the block 44.

As indicated, block 54 is identical but opposite to block 24, and accordingly, it is formed with a recess 64 receiving idler 66 that is in contact with wheel 12 at a location diametrically opposite the point at which the wheel is contacted by the idler 32. Idler 66 is free to rotate upon a shaft 68 the opposite ends of which are journalled in circular openings 67 formed in block 54 and circular openings 70 formed in rectangular support lugs 69 sliding in horizontally extending guide slots 72 of plates 30.

Referring to FIG. 1, a drain hole 74 is provided adjacent the pass-through space 16, for lubricants, grinding or buffing compounds, or other liquid compositions needed in the workpiece-conditioning operation.

The driving of the wheel can be accomplished in any of various well known ways, and for example, there can be provided a driven pulley 76, keyed or otherwise made rotatable with the wheel shaft 15. Trained about pulley 76 is a drive belt 78, which would also be trained about a drive pulley, not shown, driven by a prime mover, not shown. Since shaft 15 will move vertically downwardly to maintain pass-through space 16 at a constant value, means for maintaining the tension of drive belt 78 while still permitting the downward movement of the shaft 15 is provided, for example in the form of a tension-maintaining idler 80 spring urged into rolling contact with the belt 78.

Referring now to FIG. 1, at the discharge end of the platen, there is provided in the present instance a transversely extending end wall 82 integral with the platen or bed 10, and having at its lower end a transversely extending slot 84 through which the workpieces W may be discharged.

Threadedly engaged in opening 85 of end wall 82 is the threaded shaft 88 of a crank 86. At its inner end, shaft 88 has a circular head 90 swivelly engaged in a cavity 92 formed in block 44 in communication with a smooth-walled opening 94 opening upon the rear surface of said block.

In the use of the device shown in FIGS. 1–4, a workpiece-conditioning wheel 12 of a selected diameter is mounted on shaft 15, and is positioned above the top surface of the platen 10 a prescribed distance, according to the thickness of the workpieces W being fed through the device. This may be accomplished, for example, by temporarily positioning a spacer plate, not shown, between the wheel 12 and the surface of the platen. Said spacer plate would be of a thickness matching the desired pass-through space.

Then, with the spacer plate in place, the block 44 may be adjusted by means of crank 86 until the sensing idlers or rollers 32, 66 are in rollable contact with the wheel 12 at diametrically opposite points thereon. It may be noted, in this regard, that the plates 24, 54 will in these circumstances slide downwardly on their associated stationary blocks 18, 44 respectively until they are in contact with the wheel selected for the workpiece-conditioning operation.

The spacer plate may now be withdrawn, and the device is ready for use.

In use, it will be understood that any suitable means can be employed to cause the workpieces to move forwardly along the surface of the platen 10. They may, for example, be arranged end-to-end so that each workpiece pushes the workpiece immediately before it. Other suitable conveyor means can, of course, be employed, none being shown since the means for feeding the workpieces can vary and is not part of the present invention.

In any event, as the wheel is driven and the workpieces are passed through space 16, they will be conditioned by the wheel, that is, the upper surfaces of the workpieces will be ground, buffed, or otherwise acted upon according to the particular type of wheel 12 mounted on shaft 15.

This causes wear of the wheel periphery. This wear reduces the diameter of the wheel, and it has previously been necessary to stop the operation to make necessary adjustments for the purpose of returning the pass-through space 16 to its initial height or value.

In accordance with the present invention, however, the maintenance of the space 16 at a constant value is made automatic. Rollers 32, 66 are continuously maintained in contact with the wheel 12, and as the wheel diameter is reduced by wear, even in an amount which would not ordinarily be detectable, the rollers 32, 66 tend to move toward each other, resulting in the blocks 24, 54 sliding downwardly on their associated stationary blocks 18, 44. This causes the sensing roller support lugs 26, 69 to also move downwardly along the inclined paths with the rollers 32, 66 and the slide blocks 24, 54. As the support lugs 26, 69 move downwardly along their inclined paths, they also slide toward each other within the slots 28, 72.

The downward movement of the lugs, resulting from wear of the diameter of the wheel 12, causes the wheel support members 30 to move vertically downwardly, carrying with them the wheel shaft 15 and hence the wheel 12. This downward movement is permitted only to the extent of the amount that the wheel diameter is worn down, so that pass-through space 16 is maintained at a constant value at all times.

Figure 5:
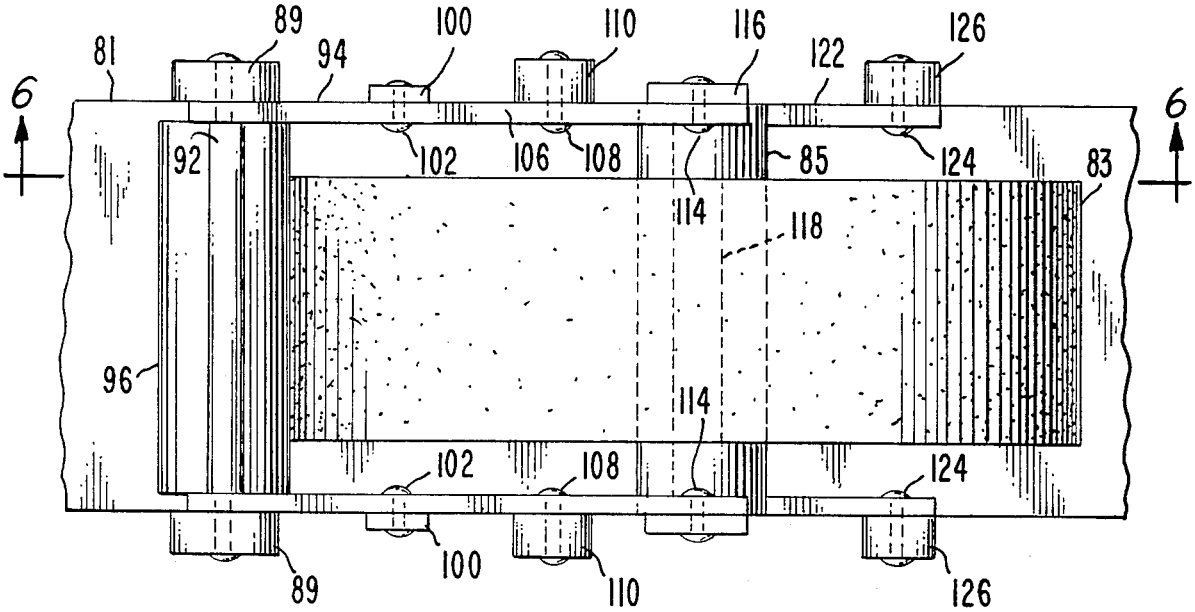
FIG. 5 is a top plan view of another modified form of the invention.
Figure 6:
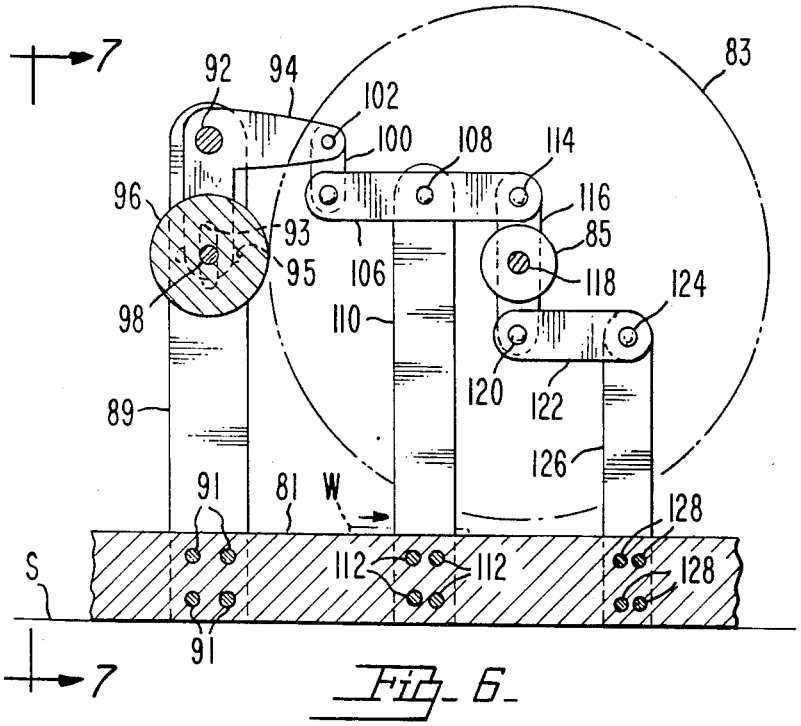
FIG. 6 is a longitudinal sectional view through the form of the invention shown in FIG. 5, taken substantially on line 6—6 of FIG. 5, a grinding wheel and workpiece being shown in phantom outline.
Figure 7:
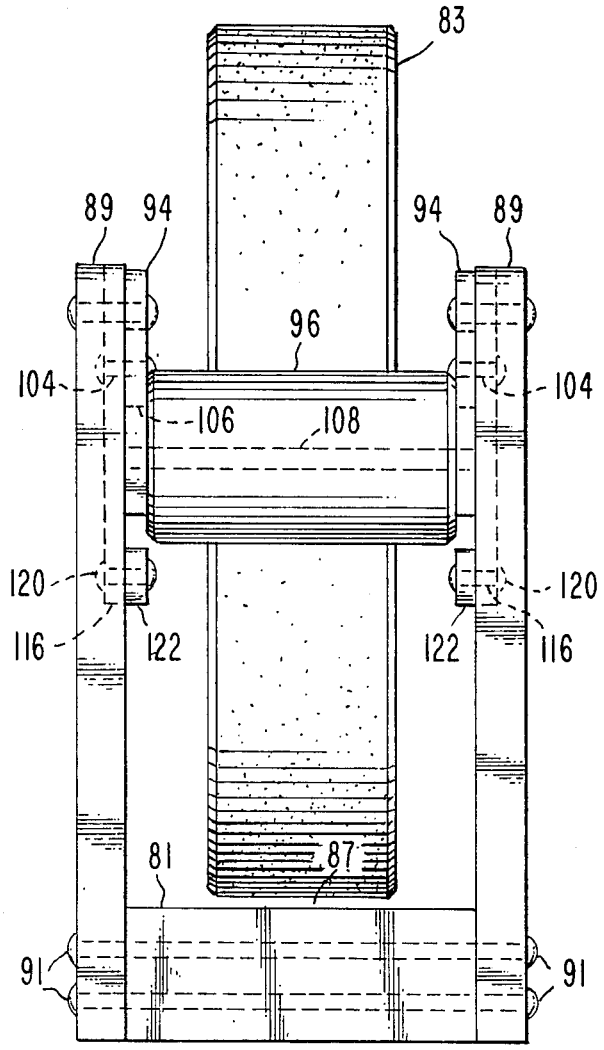
FIG. 7 is a transverse sectional view through the device taken substantially on line 7—7 of FIG. 6.

In the second form of the invention shown in FIGS. 5–7, the same principle of sensing a reduction in wheel diameter resulting from wear of the wheel, and translating a resulting movement of the sensing idler or idlers into a downward, vertical adjustment of the wheel shaft, is retained.

In this form, the platen 81 has a flat surface upon which workpieces W are fed in the same manner as in the first form of the invention. Above the platen there is provided a workpiece conditioning wheel 83, such as a grinding wheel, having a bushing or arbor 85 and supported above the upper surface of platen 81 a prescribed distance for the purpose of defining a pass-through space, of the exact height desired to properly effect the operation of grinding or otherwise conditioning the upper surfaces of the workpieces W.

At opposite sides of the platen 81, transversely aligned support posts 89 are fixedly secured to the side surfaces of the platen by bolts 91. A pin 92 extends through openings formed in the upper ends of posts 89 across the space therebetween, to pivotally mount bell crank levers 94 on the posts. The levers 94 are disposed as inverted L's, having lower ends formed with slots 93 through which passes a roller support shaft 98 extending across the space between the levers through the axial bore of a sensing roller of idler 96. Shaft 98 also extends through horizontal slots 95 formed in posts 89. This assures that when the lower ends of bell cranks 94 travel in an arcuate path about the axis defined by pins 92, the shaft 98, and hence roller 96 will travel in a straight horizontal path to maintain the axes of the wheel 83 and roller 96 in a common horizontal plane, viewing the same as in FIG. 6.

The upper, horizontally extending legs of levers 94 are pivotally connected to short, vertically depending links 100 by pins 102, said links being pivotally connected at 104, at their lower ends, to straight, generally horizontal levers 106 pivotally mounted intermediate their ends at 108 on the upper ends of upstanding support posts 110 fixedly secured to the opposite sides of the platen by bolts 112.

At the other ends of the links 106, pins 114 pivotally connect thereto the upper ends of generally vertical links 116 having intermediate their ends openings receiving the opposite ends of the wheel shaft 118 extending through arbor 85.

Pivotally connected at 120 to the lower ends of links 116 are one end of links 122, the other ends of which are pivotally connected at 124 to the upper ends of stationary support posts 126 fixedly secured by bolts 128 to the opposite sides of the platen 81.

This form of the device permits utilization of a single idler roller 96. However, it is within the scope of concept illustrated in FIGS. 5–7, to provide another idler roller diametrically opposite the roller 96, together with an articulated linkage of links and levers that would be identical to but opposite from the link-and-lever assemblage illustrated, having in common therewith the links 116.

In use of the form of the invention shown in FIGS. 5–7, the weight of the wheel 83, exerted upon the linkage through shaft 118, tends to shift the link 116, rocking the levers 106 clockwide as viewed in FIG. 6, and thereby rocking the bell crank lever counterclockwise as seen in the same figure of drawing. This causes roller 96 to be firmly engaged in rollable contact with the wheel, in a frictional engagement effective to prevent the wheel 83 from dropping down fully into contact with the upper surface of platen 81. As a result, the pass-through space is defined, and will remain constant by reason of the fact that as the wheel diameter wears, roller 96 tends to shift to the right as seen in FIG. 6. This rocks the bell crank lever 94 counterclockwise as viewed in the same figure of the drawings, rocking lever 106 clockwise to lower the links 116 and hence the shaft 118 a distance effective to take up for the wear, thus maintaining the pass-through space at a constant value.

It will be understood that the grinding wheel 83 would be driven by any suitable means, as for example, by a pulley 76 and belt 78 similar to that illustrated in the first form of the invention. The pulley would be secured to the shaft 118 in the same manner that it is illustrated as being secured to the shaft 15 of the form of the invention shown in FIGS. 1–4. This is considered sufficiently obvious as not to require special illustration.

Figure 1A:
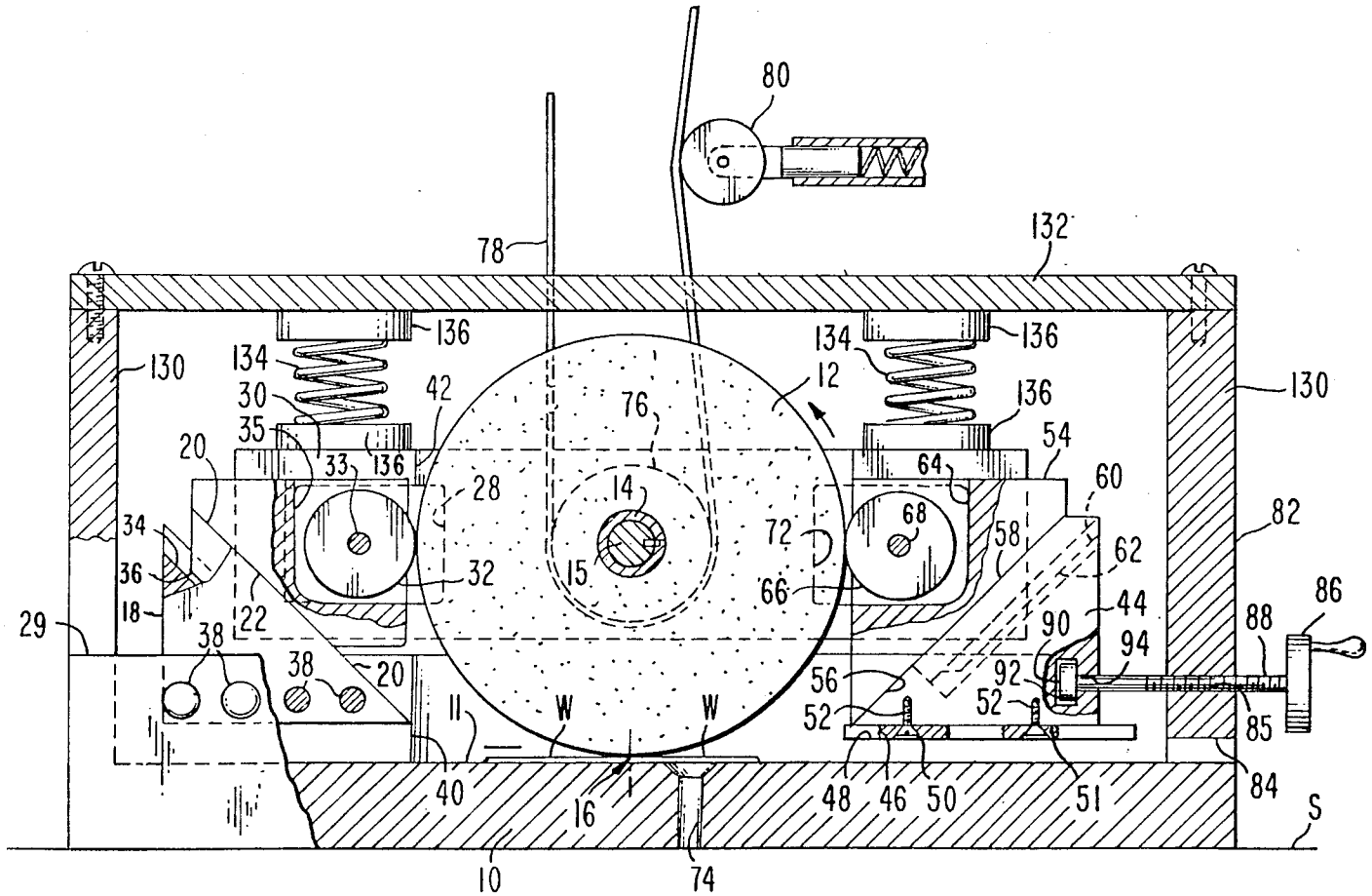
FIGS. 1*a* and 1*b* are views similar to FIG. 1 showing modified constructions.

Throughout this specification, both forms of the invention have been described in terms of gravity being the force that shifts the work conditioning wheel 12 or 83 toward the associated platen or bed surface. Alternatively, the force could be exerted by springs or hydraulic rams, in the manner shown, for example, in FIG. 1*a*. Although any of various arrangements can be used to supply a force other than gravity for urging the wheel toward the platen, by way of example FIG. 1*a* illustrates the end wall 82 having an integral extension 130. At the other end of the platen a similar end wall and extension thereof are provided. Fixedly secured to and extending between the end wall extensions 130 is a cover plate 132 overlying bearing members 30, and held under compression between the cover plate and the respective bearing members are springs 134 which may be mounted in cups 136 secured to the cover plate and bearing members respectively. Alternatively, hydraulic rams or the like, not shown, may be utilized to exert a continuing force against the respective bearing members 30 in the direction of platen 10.

This permits the device to be mounted, for example, upon a vertical wall or an inclined surface. Even when the device is mounted upon a horizontal support surface S as illustrated in FIG. 1*a*, the use of a controlled force applicator such as springs or hydraulic means may have the desirable result of damping a vibration or "bouncing" of the grinding wheel and the associated movable components of the assembly.

Figure 1B:
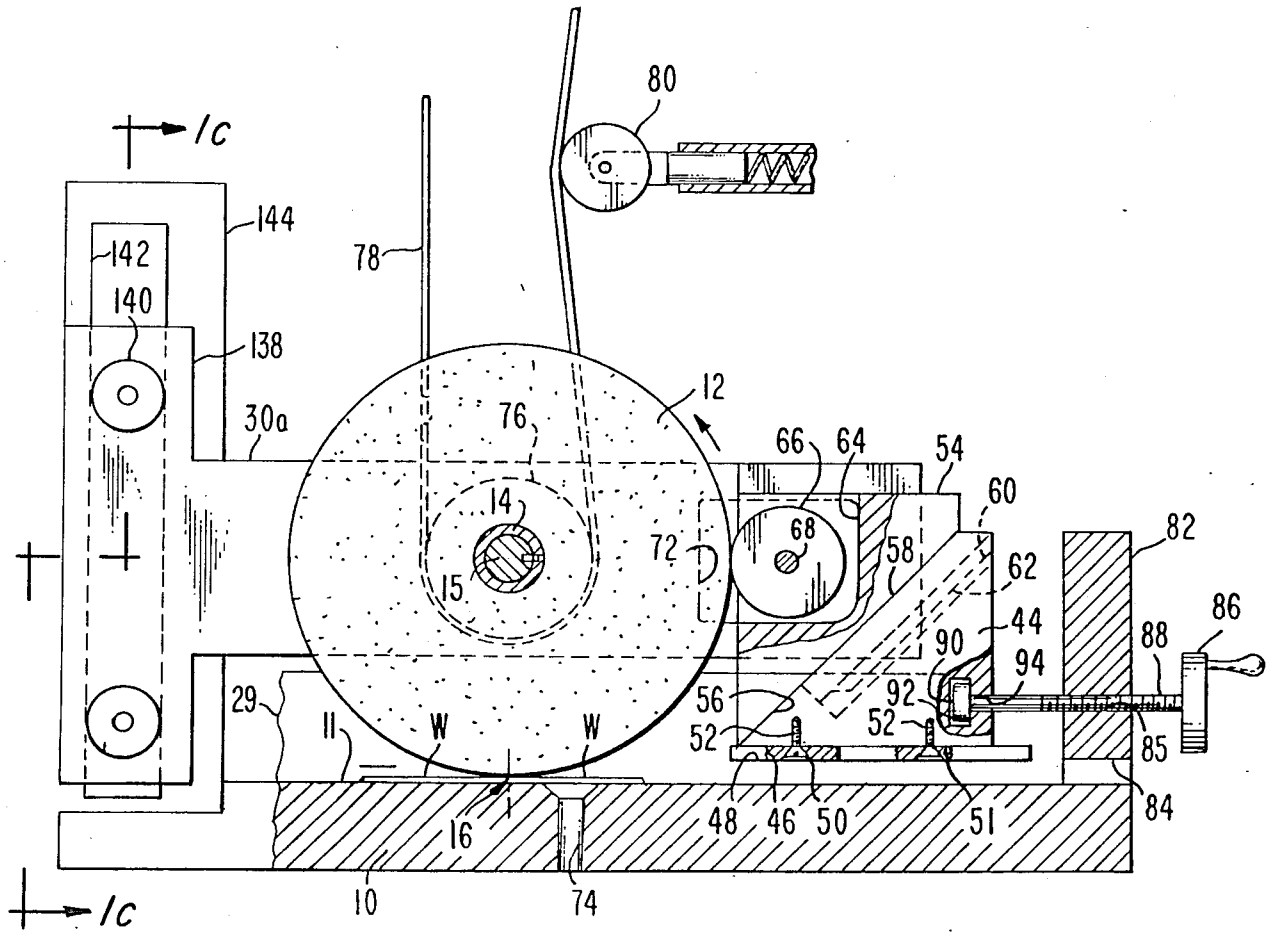
Figure 1C:
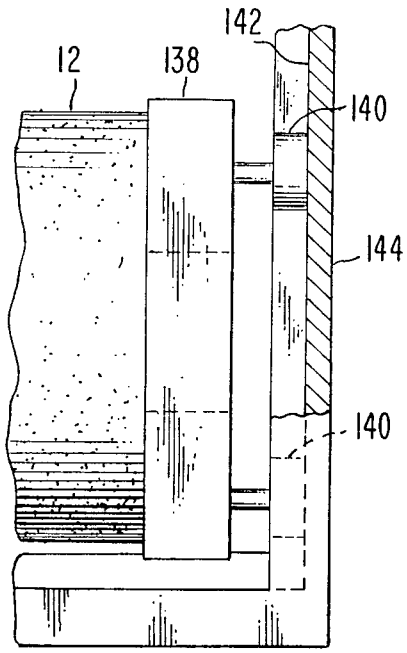
FIG. 1*c* is a cross-sectional view substantially on line 1*c*—1*c* of FIG. 1*b*.

In FIG. 1*b* there is illustrated yet another modification, wherein it is shown that it is possible, if desired, to dispense with one of the sensing rollers and its associated slide block and stationary support block in the type of arrangement shown basically in FIG. 1. In this form of the invention, the entire idler roller and block-and-lug assembly shown at the left in FIGS. 1 and 1*a* is dispensed with, and bearing members 30*a* are instead formed at that end of the structure with cross heads 138, from which extend laterally outwardly spaced guide rollers 140 mounted in tracks 142 of side wall extensions 144 integrally formed upon the side walls 29.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A workpiece-conditioning wheel assembly comprising:

(a) a workpiece support element including a platen having a planar bed surface adapted for the feeding of workpieces therealong in successively following order;

(b) a wheel support shaft spaced from said element;

(c) support means for the wheel shaft including at least one elongated plate providing a bearing for said shaft, said plate being spaced from and being mounted for movement toward said bed surface along a path normal to the plane of the bed surface, said plate having at least one guide slot;

(d) a workpiece-conditioning wheel carried by said shaft and spaced from said bed surface to define a pass-through space between the wheel and said surface through which workpieces may be fed for conditioning of said workpieces by the wheel;

(e) sensing means including an idler roller in contact with the wheel and movable toward the wheel along a path parallel to the plane of the bed surface, said sensing means further including a support lug slidably mounted in the guide slot for movement parallel to the path of the roller, and a pin bearing in the support lug and supporting the pin for rotation and for movement toward the wheel concurrently with said movement of the lug within the slot, said roller moving toward the wheel responsive to reductions of the wheel diameter resulting from wear of the wheel at its periphery; and (f) motion-translating means extending between the sensing means and the wheel shaft support means and adapted to translate movements of the sensing means into an adjustment of the wheel shaft support means toward the workpiece support element effective to maintain saied pass-through space at a constant value, comprising a stationary support block mounted on the workpiece support element and having an inclined surface facing toward the periphery of the wheel and sloped downwardly toward the bed surace, and an idler roller support block supported upon said inclined surface for travel downwardly along the inclined surface thereof toward said bed surface, said pin and roller rotatably bearing in the roller support block whereby wear of the wheel will produce the downward travel of the roller support block along said inclined path so as to advance the lug within the guide slot while imparting downward movement thereto, and by so doing shift the plate, the wheel support shaft, and the grinding wheel toward the bed surface along said path upon which the plate is movable normally to the plane of the bed surface.

2. A workpiece-conditioning wheel as in claim 1 including a second sensing means comprising a second idler roller in contact with the wheel at a point on the wheel diametrically opposite that at which the first named roller is in contact therewith, a pin carrying the second roller, a second stationary block mounted on the workpiece support element having an inclined surface sloped oppositely to that of the first named stationary block, said wheel lying between the inclined surfaces of the stationary blocks and said inclined surfaces converging toward the bed surface of the platen, a second idler roller support block slidably supported on the inclined surface of the second stationary block, the second named roller and pin being rotatably mounted in the second idler roller support block, the plate having a second guide slot aligned longitudinally of the plate with the first named slot, and a second support lug slidably mounted in the second named slot, whereby said first and second sensing means comprise guide means supporting the plate at opposite sides of the wheel for straight-line movement toward the bed surface normally to the plane of the bed surface.

3. A workpiece-conditioning wheel as in claim 2, wherein the wheel shaft support means comprises a pair of said elongated plates extending horizontally between the respective roller and block assemblies at opposite sides of the wheel, said plates being formed with identical pairs of guide slots and with transversely aligned bearings for the wheel support shaft.

4. A workpiece-conditioning wheel as in claim 2 wherein one stationary block is fixedly secured to the platen, the stationary block at the diametrically opposite side of the wheel being mounted on the platen for slidable adjustment toward and away from the other stationary block whereby to accommodate wheels of different sizes therebeween.

5. A workpiece-conditioning wheel assembly as in claim 2 wherein the plate, and said idler roller support blocks are movable toward said element by gravitational force.

6. A workpiece-conditioning wheel assembly as in claim 3 including spring means exerting force against the shaft support means tending to move the same toward said element, said assembly including a cover plate secured to and overlying said first and second named plates, and said spring means comprising a plurality of springs extending between the cover plate and said first and second named plates and tensioned to exert a resiliently yielding, continuous force thereagainst tending to bias the same toward the bed surface.

7. A workpiece-conditioning wheel assembly as in claim 1 wherein said plate extends beyond diametrically opposite locations on the wheel in parallel relation with the bed surface, the guide lug, idler roller, and said blocks being disposed adjacent one end of the plate, said plate at its other end including a cross head extending normally to the length of the plate, guide rollers carried by said cross head, and an extension projecting upwardly from the platen, said extension having an elongated track extending parallel to the path of movement of the plate toward the bed surface, and said guide rollers of the cross head being mounted in the track, so as to guide the plate in its movement toward the bed surface.

* * * * *